US006859626B2

(12) United States Patent
Kimizuka et al.

(10) Patent No.: US 6,859,626 B2
(45) Date of Patent: Feb. 22, 2005

(54) PROCESS CARTRIDGE HAVING STORAGE DEVICE WHICH COMMUNICATES WITH IMAGE FORMING APPARATUS

(75) Inventors: Eiichiro Kimizuka, Shizuoka-ken (JP); Masanobu Kanoto, Shizuoka-ken (JP); Kazushige Sakurai, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/216,220

(22) Filed: Aug. 12, 2002

(65) Prior Publication Data

US 2003/0002880 A1 Jan. 2, 2003

Related U.S. Application Data

(62) Division of application No. 09/671,649, filed on Sep. 28, 2000, now Pat. No. 6,438,327.

(30) Foreign Application Priority Data

Sep. 29, 1999 (JP) ..... 11-276206

(51) Int. Cl.[7] ..... G03G 15/00
(52) U.S. Cl. ..... 399/12; 399/25
(58) Field of Search ..... 399/9, 12, 24, 399/25, 31, 111

(56) References Cited

U.S. PATENT DOCUMENTS

| | | | | |
|---|---|---|---|---|
| 5,343,276 A | | 8/1994 | Yamashita et al. | 399/8 |
| 5,937,239 A | | 8/1999 | Watanabe et al. | 399/111 |
| 6,163,658 A | | 12/2000 | Suzuki | 399/12 |
| 6,212,338 B1 | | 4/2001 | Hagihara et al. | 399/12 |
| 6,438,327 B1 | * | 8/2002 | Kimizuka et al. | 399/12 |
| 6,608,975 B2 | * | 8/2003 | Sakurai et al. | 399/25 |

FOREIGN PATENT DOCUMENTS

| | | |
|---|---|---|
| JP | 11-305632 | 11/1999 |
| JP | 11-348375 | 12/1999 |
| JP | 2001-194966 | 7/2001 |

* cited by examiner

*Primary Examiner*—Robert Beatty
(74) *Attorney, Agent, or Firm*—Fitzpatrick, Cella, Harper & Scinto

(57) ABSTRACT

A process cartridge detachable mountable to a main assembly of an electrophotographic image forming apparatus includes an electrophotographic photosensitive drum; a developing roller for developing an electrostatic latent image formed on the photosensitive drum with developer; a transferring roller for causing transfer of the developer image from the photosensitive drum to a recording material; a cleaner, contacted to the photosensitive drum, for removing a developer remaining on the photosensitive drum; a developer accommodating portion for accommodating developer removed from the photosensitive drum by the cleaner; and a memory including a storing portion for storing predetermined information and a communicator for effecting wireless communication of the predetermined information stored in the storing portion with a main assembly side communicator provided in the main assembly of the electrophotographic image forming apparatus. The storing portion is disposed inside the developer accommodating portion and the storing portion is disposed on the same side of the process cartridge as the photosensitive drum with respect to tangent lines passing a contact point between the photosensitive drum and the developing roller or transfer roller.

4 Claims, 6 Drawing Sheets

PROCESS CARTRIDGE HAVING STORAGE DEVICE WHICH COMMUNICATES WITH IMAGE FORMING APPARATUS

This application is a divisional of U.S. patent application Ser. No. 09/671,649, filed Sep. 28, 2000, now U.S. Pat. No. 6,438,327, issued Aug. 20, 2002.

FIELD OF THE INVENTION AND RELATED ART

The present invention relates to a process cartridge and an electrophotographic image forming apparatus. In this specification, an electrophotographic image forming apparatus means such an apparatus that records images on recording media using an electrophotographic image formation system. The examples of electrophotographic image forming apparatuses include electrophotographic copying machines, electrophotographic printers (laser printers, LED printers, and the like), facsimile apparatuses, word processors, and the like.

A process cartridge is: a cartridge in which a charging means, a developing means or a cleaning means, and an electrophotographic photosensitive member, are integrally placed, and which is enabled to be removably installed in the main assembly of an image forming apparatus; a cartridge in which at least one among a charging means, a developing means, and a cleaning means, and an electrophotographic photosensitive member, are integrally placed, and which is enabled to be removably installed in the main assembly of an image forming apparatus; or a cartridge in which at least a developing means and an electrophotographic photosensitive member are integrally placed, and which is enabled to be removably installed in the main assembly of an image forming apparatus.

In the past, an electrophotographic image forming apparatus which employs an electrophotographic image forming process has been employing a process cartridge system, according to which an electrophotographic photosensitive member, and a single or plural processing means which act on the electrophotographic photosensitive member, are integrally placed in a cartridge removably installable in the main assembly of an image forming apparatus. This process cartridge system makes it possible for a user to maintain the apparatus without relying on maintenance personnel, drastically improving operational efficiency. Thus, the process cartridge system has been widely used in the field of image forming apparatuses.

A process cartridge is provided with an information storing means in which the history or specification values of the process cartridge are registered. The information storing means is enabled to communicate with the main assembly of an electrophotographic image forming apparatus so that the maintenance of the electrophotographic image forming apparatus main assembly and the process cartridge can be simplified or image quality can be improved. Some process cartridges are provided with a connector or the like which connects the electrophotographic image forming apparatus main assembly to the information storing means of the process cartridge. In order to eliminate the need for a mechanical connector which tends to increase the cartridge size, it has been considered to employ a noncontact communication system.

However, in the case of a process cartridge employing a wireless communication system, the aforementioned information storing means is affected by the electrical noises generated by the processing members, for example, a charge roller, a development sleeve, and a transfer roller of the apparatus main assembly, to which bias is applied from the electrophotographic image forming apparatus. Therefore, there is a chance that the contents of the information storing means will be destroyed or written over with erroneous information.

The present information is one of the results of the further development of the above described conventional technologies.

SUMMARY OF THE INVENTION

The primary object of the present invention is to provide a process cartridge enabled to wirelessly communicate with the main assembly of an electrophotographic image forming apparatus, and an electrophotographic image forming apparatus in which such a process cartridge is removably installable.

Another object of the present invention is to provide a process cartridge capable of preventing the contents of the information storing means, which communicates with the main assembly of an electrophotographic image forming apparatus, from being destroyed or written over with erroneous information, and an electrophotographic image forming apparatus in which such a process cartridge is removably installable.

Another object of the present invention is to provide a process cartridge in which an electrophotographic photosensitive drum is supported by a supporting means, and the information storing means is placed in the dead angle created by the electrophotographic photosensitive drum supporting means, as seen from any point on the linear interface between the charging means and the electrophotographic photosensitive means toward the photosensitive drum in a direction perpendicular to the longitudinal direction of the photosensitive drum, and an electrophotographic image forming apparatus in which such a process cartridge is removably installable.

Another object of the present invention is to provide a process cartridge in which the information storing means is placed on the electrophotographic photosensitive drum side with respect to a plane, which is tangent to the peripheral surface of the electrophotographic photosensitive drum at the linear interface between the electrophotographic photosensitive drum and charging means, and is perpendicular to the longitudinal direction of the electrophotographic photosensitive drum, and also to provide an electrophotographic image forming apparatus in which such a process cartridge is removably installable.

Another object of the present invention is to provide a process cartridge in which an information storing means is placed on the electrophotographic photosensitive drum side, with respect to a plane which is tangent to the peripheral surface of the electrophotographic photosensitive drum at the linear interface between the transferring means and electrophotographic photosensitive drum, and is perpendicular to the longitudinal direction of the electrophotographic photosensitive drum, and also to provide an electrophotographic image forming apparatus in which such a process cartridge is removably installable.

Another object of the present invention is to provide a process cartridge in which the information storing means is placed on the electrophotographic photosensitive drum side, with respect to the plane which is tangent to the peripheral surface of the electrophotographic photosensitive drum at the linear interface between the electrophotographic photosensitive drum and developing means, and is perpendicular to the longitudinal direction of the electrophotographic photosensitive drum, and also to provide an electrophotographic image forming apparatus in which such a process cartridge is removably installable.

Another object of the present invention is to provide a process cartridge in which the information storing means is placed outside a theoretical cylinder, the center line of which coincides with the axial line of the electrophotographic photosensitive drum, and which envelops the charging means, developing means, and transferring means, and also to provide an electrophotographic image forming apparatus in which such a process cartridge is removably installable.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

Embodiment 1

Figure 1:
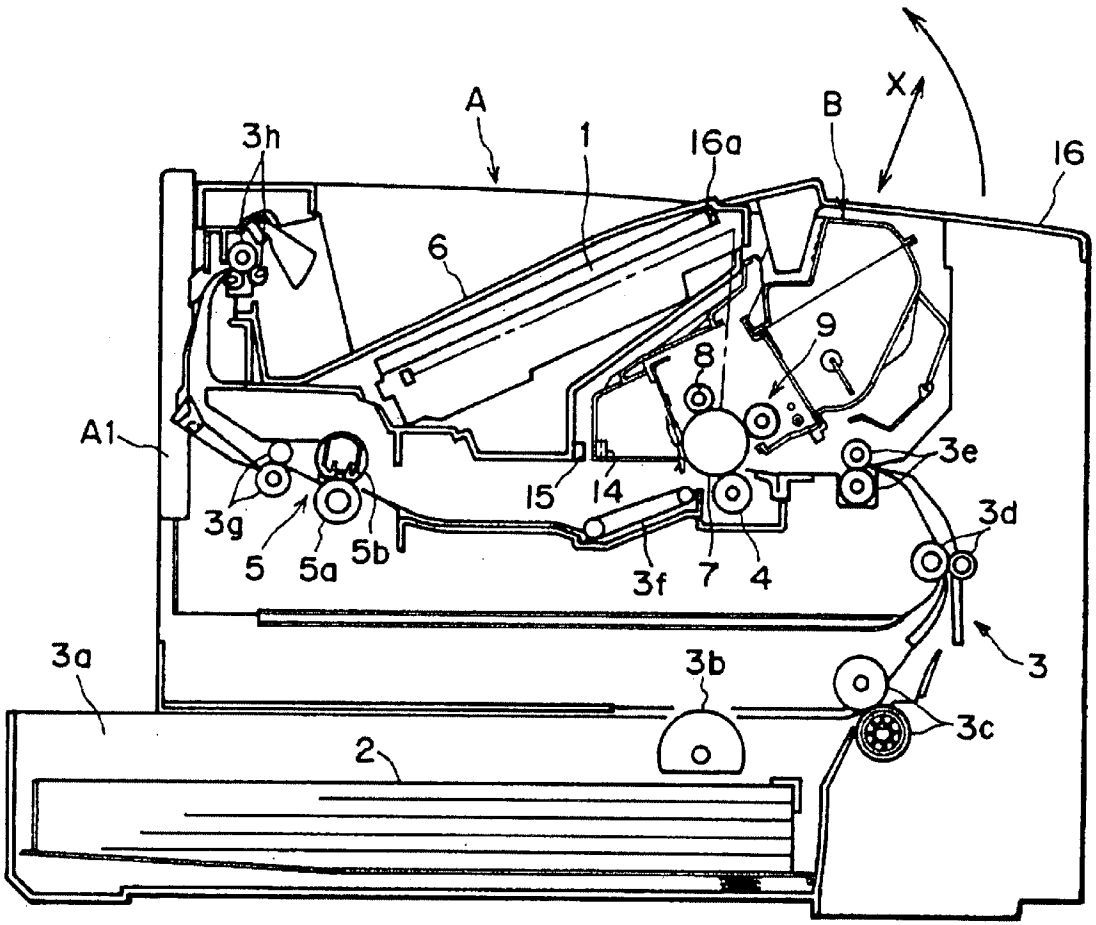
FIG. 1 is a sectional view of an electrophotographic image forming apparatus in accordance with the present invention.
Figure 2:
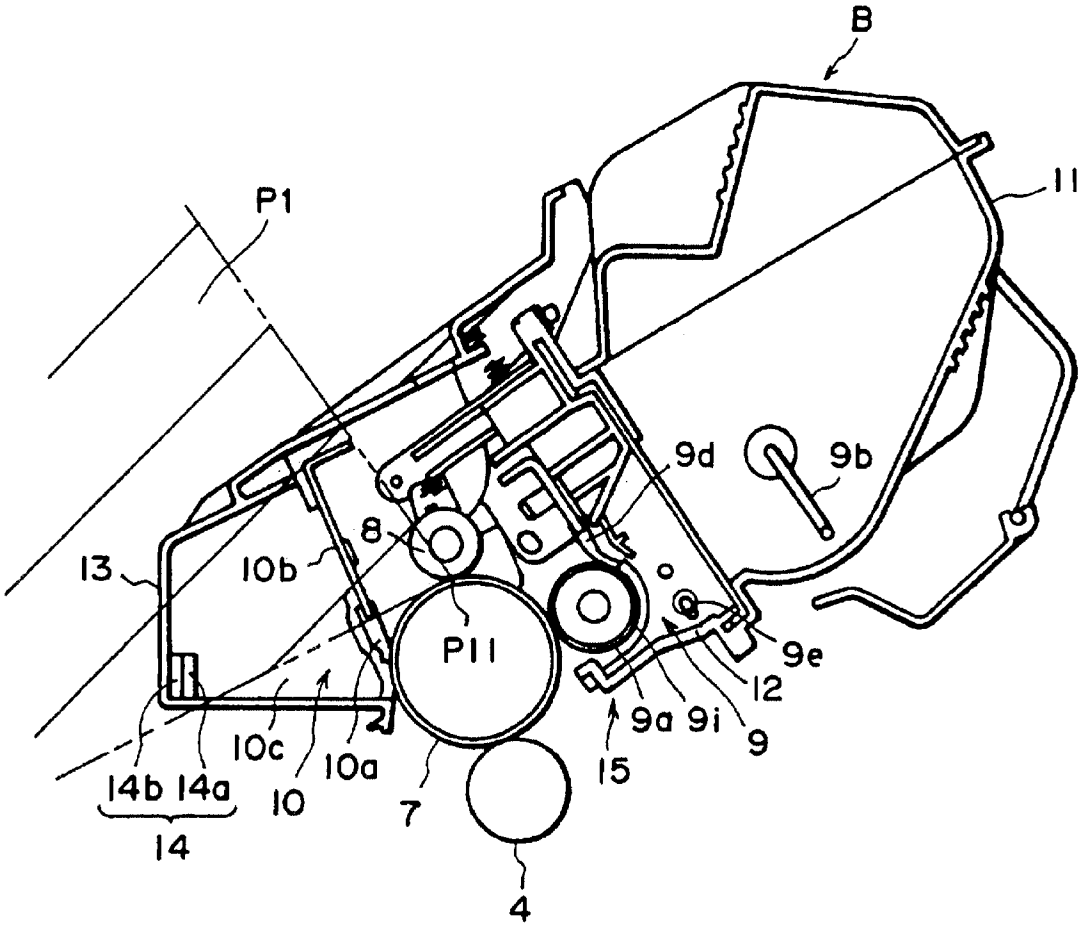
FIG. 2 is a sectional view of the process cartridge in the first embodiment of the present invention.

Referring to FIGS. 1 and 2, a process cartridge will be described along with an electrophotographic image forming apparatus in which a process cartridge is removably installable. FIG. 1 is a sectional view of an electrophotographic image forming apparatus (laser beam printer) in which a process cartridge has been installed, and depicts the general structure of the apparatus. FIG. 2 is a sectional view of a process cartridge, and depicts the general structure thereof.

As for the order of descriptions, first, the general structure of an electrophotographic image forming apparatus in which a process cartridge has been installed will be described, and then, the structure of a process cartridge will be described.

(General Structure)

Referring to FIG. 1, this electrophotographic image forming apparatus A (laser beam printer) is such an apparatus that forms an image on recording media (for example, recording paper, OHP sheet, fabric, and the like) with the use of an electrophotographic image formation process. In operation, it forms a toner image (developer image) on an electrophotographic photosensitive drum 7 (hereinafter, "photosensitive drum") in the form of a drum. More specifically, the photosensitive drum 7 is charged by a charging means 8, and then, the photosensitive drum 7 is exposed to a laser beam projected onto the photosensitive drum 7 from an optical means 1 while being modulated with image formation information, to form an electrostatic latent image in accordance with the image formation information, on the photosensitive drum 7. The thus formed electrostatic latent image is developed into a toner image by a developing means 9.

Meanwhile, a recording medium 2 having been placed in a cassette 3*a* is conveyed by a conveying means 3 comprising a pickup roller 3*b*, a combination 3*c* of a feed roller and retard roller, two pairs 3*d* and 3*e* of conveying rollers, and the like, while being turned over, in synchronism with the toner image formation. Next, the toner image formed on the photosensitive drum 7 in the process cartridge B is transferred onto the recording medium 2 by applying voltage (transfer bias) to a transfer roller 4 as a transferring means with which the main assembly A1 (hereinafter, "image forming apparatus main assembly") of an electrophotographic image forming apparatus is provided. The transfer roller 4 comes into contact with the photosensitive drum 7 in such a manner that the linear interface between the two rollers becomes parallel to the longitudinal direction (axial line direction) of the photosensitive drum 7, as the process cartridge B is installed into the image forming apparatus main assembly A1.

After receiving the toner image, the recording medium 2 is conveyed to a fixing means 5 by a conveyer belt 3*f*. The fixing means 5 comprises a driver roller 5*a* and a rotational fixing member 5*b*. The rotational fixing member 5*b* is a cylindrical sheet, and contains a heater. It is rotatably supported by a supporting member. The fixing means 5 applies pressure and heat to the recording medium 2 to fix the transferred toner image to the recording medium 2 while the recording medium 2 is passing through the fixing means 5.

Thereafter, the recording medium 2 is conveyed through a reversing path, and discharged into a delivery tray 6, by two pairs 3*g* and 3*h* of discharge rollers. The aforementioned optical means 1 comprises a laser diode, a polygon mirror, a lens, and a refection mirror, although they are not illustrated.

(Process Cartridge Structure)

The process cartridge B is such a cartridge that is provided with an electrophotographic photosensitive member, and at least one processing means. As for processing means, there are a charging means for charging an electrophotographic photosensitive member, a developing means for developing an electrostatic latent image formed on an electrophotographic photosensitive member, and a cleaning means for cleaning the toner particles remaining on the peripheral surface of an electrophotographic photosensitive member, for example. Referring to FIG. 2, in the process cartridge B in this embodiment, the photosensitive drum 7 with a photosensitive layer is rotated, and while it is rotated, its peripheral surface is uniformly charged by the voltage (charge bias) applied to a primary charge roller 8 (hereinafter, "charge roller") as a charging means. Then, a laser beam modulated with the image formation information from the optical means 1 is projected upon the photosensitive drum 7 through an exposure opening (unillustrated) to form an electrostatic latent image. This electrostatic latent image is developed by the developing means 9 which uses toner. More specifically, the charge roller 8 is placed in contact with the photosensitive drum 7 in such a manner that the longitudinal axes of the two components become parallel to each other. As charge bias is applied to the charge roller 8 from the image forming apparatus main assembly A1, the photosensitive drum 7 is charged. The charge roller 8 rotates by following the rotation of the photosensitive drum 7. The developing means 9 supplies the development region of the photosensitive drum 7 with toner to develop the electrostatic image formed on the photosensitive drum 7.

The developing means 9 sends the toner within the toner container 11 toward a development sleeve 9*a* by the rotation of a toner conveying member 9*b*. Further, it rotates the development sleeve 9*a*, in which a stationary magnet is contained, and forms a layer of toner on the peripheral surface of the development sleeve 9*a*, while triboelectrically charging the toner, by a development blade 9*d*. The triboelectrically charged toner on the peripheral surface of the development sleeve 9*a* is supplied to the development region of the photosensitive drum 7. The development sleeve 9*a* is provided with a pair of spacer rings 9*i* as a gap maintaining means, which are fitted one for one around the longitudinal (axial direction) end portions of the development sleeve 9*a*, and remain in contact with the peripheral surface of the photosensitive drum 7 at the longitudinal ends of the photosensitive drum 7, maintaining a predetermined distance between the peripheral surface of the development sleeve 9*a* and photosensitive drum 7. In operation, development bias is applied from the image forming apparatus main assembly A1 to the development sleeve 9*a* so that the toner on the development sleeve 9*a* is transferred onto the photosensitive drum 7 in accordance with the pattern of the aforementioned electrostatic latent image to form a toner image, or a visual image. The development blade 9*d* is a blade for regulating the amount of the toner on the peripheral surface of the development sleeve 9*a*, as well as for charging the toner. In the areas adjacent to the development sleeve 9*a*, a toner stirring member 9*e* for recirculating the toner within the development chamber is rotatably mounted.

After the toner image formed on the photosensitive drum 7 is transferred onto the recording medium 2 by applying voltage (transfer bias) opposite in polarity to the toner image, to the transfer roller 4, the toner particles remaining on the photosensitive drum 7 are removed by the cleaning means 10. More specifically, the cleaning means 10 scrapes the toner particles remaining on the photosensitive drum 7, down into the waste toner bin 10*c* by the rubber cleaning blade 10*a* attached to the longitudinal tip portion of a cleaning blade holding member 10*b*. The cleaning blade holding member 10*b* is formed of a piece of electrically conductive plate, and holds the rubber cleaning blade 10*a* in such a manner that the rubber cleaning blade 10*a* extends in the longitudinal direction of the photosensitive drum 7.

The process cartridge B in this embodiment comprises: a toner container 11 which stores toner, and has a toner conveying member 9*b*; a developing means container 12 which holds the developing means such as the development sleeve 9*a*, development blade 9*d*, and the like; a cleaning means frame 13 to which the photosensitive drum 7, the cleaning means 10 such as the rubber cleaning blade 10*a*, cleaning blade holding member 10*b*, and the like, and the charge roller 8, are attached. In assembling the process cartridge B, first, the toner container 11 and developing means container 12 are joined together, forming a developing means frame 15, and then, the developing means frame 15 is integrated with the cleaning means frame, completing the process cartridge B, which is removably installable into the cartridge installing means of the image forming apparatus main assembly A1 by an operator.

Referring again to FIG. 1, the cartridge installing means comprises a lid 16 which can be rotationally opened about an axis 16*a*, and cartridge guiding members (unillustrated) located on the internal surfaces of the left and right side walls of the cartridge installation space, which can be exposed by opening the lid 16. During the installation or removal of the process cartridge B, the guiding portions of the process cartridge B, which comprise bosses and ribs, engage with the cartridge installation guiding means on the image forming apparatus main assembly A1 side and are guided thereby, so that the process cartridge B is installed into or removed from the image forming apparatus main assembly in the direction of an arrow mark A.

(Description of Electrical Contact Points)

The process cartridge B is provided with a charge bias contact point (unillustrated) for applying charge bias to the charge roller 8 from the image forming apparatus main assembly A1, a development bias contact point (unillustrated) for applying development bias to the development sleeve 9*a*, and a ground contact point (unillustrated) for grounding the photosensitive drum 7, which are placed at predetermined locations. The image forming apparatus main assembly A1 is provided with a charge bias contact point member (unillustrated), a development bias contact point member (unillustrated), and a ground contact point member (unillustrated), which make electrical contact with the charge bias contact point, development bias contact point, and ground contact point, correspondingly, as the process cartridge B is inserted to a predetermined point in the aforementioned cartridge installation space. Thus, as the process cartridge B arrives at the predetermined point in the cartridge installation space by being guided by the installation guiding member of the image forming apparatus main assembly A1, the charge bias contact point makes electrical contact with the charge bias contact point member, the development bias contact point makes electrical contact with the development bias contact point member, and the ground contact point makes electrical contact with the ground contact point member. As a result, it becomes possible for the charge bias (compound bias comprising AC voltage and DC voltage) to be applied to the charge roller 8 from an unillustrated bias supplying source (electrical power source) of the image forming apparatus main assembly A1 through the charge bias contact point member and charge bias contact point, and for the development bias to be applied to the development sleeve 9*a* from the above mentioned bias supplying source through the development bias contact point member and development bias contact point. Further, it becomes possible for the transfer bias to be applied to the transfer roller 4 from the aforementioned bias supplying source.

(Means for Preventing Bias Application Noise Reaching Information Storing Means)

Referring to FIGS. 1 and 2, the process cartridge B in this embodiment is provided with an information storing means 14 for communicating with the image forming apparatus main assembly A1 in a noncontact manner, that is, wirelessly. The information storing means 14 is placed within the cleaning means frame 13. As the process cartridge B is installed into the image forming apparatus main assembly A1, the information storing means 14 comes to face a communication antenna 15 as the communicating means in the image forming apparatus main assembly A1, being therefore enabled to communicate with the image forming apparatus main assembly A1. The information storing means 14 comprises an information storing portion 14*a* for storing predetermined information, and a communicating means 14*b* for communicating with the image forming apparatus main assembly A1, which are integrated.

In this embodiment, a wireless communication system based on electromagnetic induction is employed as a noncontact communication system. More specifically, a magnetic core integral with the information storing portion 14*a* of the information storing means 14 is used as the communicating means 14*b* on the process cartridge B side, and the image forming apparatus main assembly A1 is provided with an inductor as the communicating means on the image forming apparatus main assembly A1 side, so that the communication between the image forming apparatus main assembly A1 and process cartridge B can be carried out by electromagnetic induction through the magnetic core. In operation, predetermined types of information, for example, service history or cartridge specification values, are registered in the information storing portion 14*a* of the information storing means 14, so that the maintenance of the image forming apparatus main assembly A1 or process cartridge B is simplified, and/or image quality is improved through the communication between the process cartridge B and image forming apparatus main assembly A1.

Referring to FIG. 2, the information storing means 14 is placed in a dead region P1 (hatched region) created by the cleaning blade holding member 10*b*, in terms of the electromagnetic waves radiating from any point on the linear interface P11 between the charge roller 8 and photosensitive drum 7 in the direction intersecting (approximately perpendicular) the longitudinal direction of the photosensitive drum 7. This placement of the information storing means 14 is effective to make the cleaning blade holding member 10*b* shield the information storing means 14 from the noises created by the bias applied to the charge roller 8, making it possible to prevent the information storing portion 14*a* of the information storing means from being affected by the above described noise; it is effective to prevent the information stored in the information storing portion 14*a* from being destroyed by the noise. In other words, since the information storing portion 14*a* is shielded by the cleaning blade holding member 10*b* from the effects of the noises generated by the charge bias applied to the charge roller 8, the predetermined information stored in the information storing member 14*a* of the information storing means 4 is prevented from being destroyed or written over with erroneous information. Thus, it is possible to prevent the effects of the noises generated by the charge bias applied to the charge roller 8 that the information storing means 14 destroys the information stored therein, or erroneously operates.

Embodiment 2

In this embodiment, another example of a process cartridge in accordance with the present invention will be described. In this cartridge, in order to prevent the information storing means 14 from being affected by the noises caused by the charge bias applied to the charge roller 8 of the process cartridge B, the information storing means 14 is placed within the cleaning means frame 13. The components in this cartridge similar to those in the process cartridge B in the first embodiment are given the same reference codes as those in the first embodiment.

Figure 3:
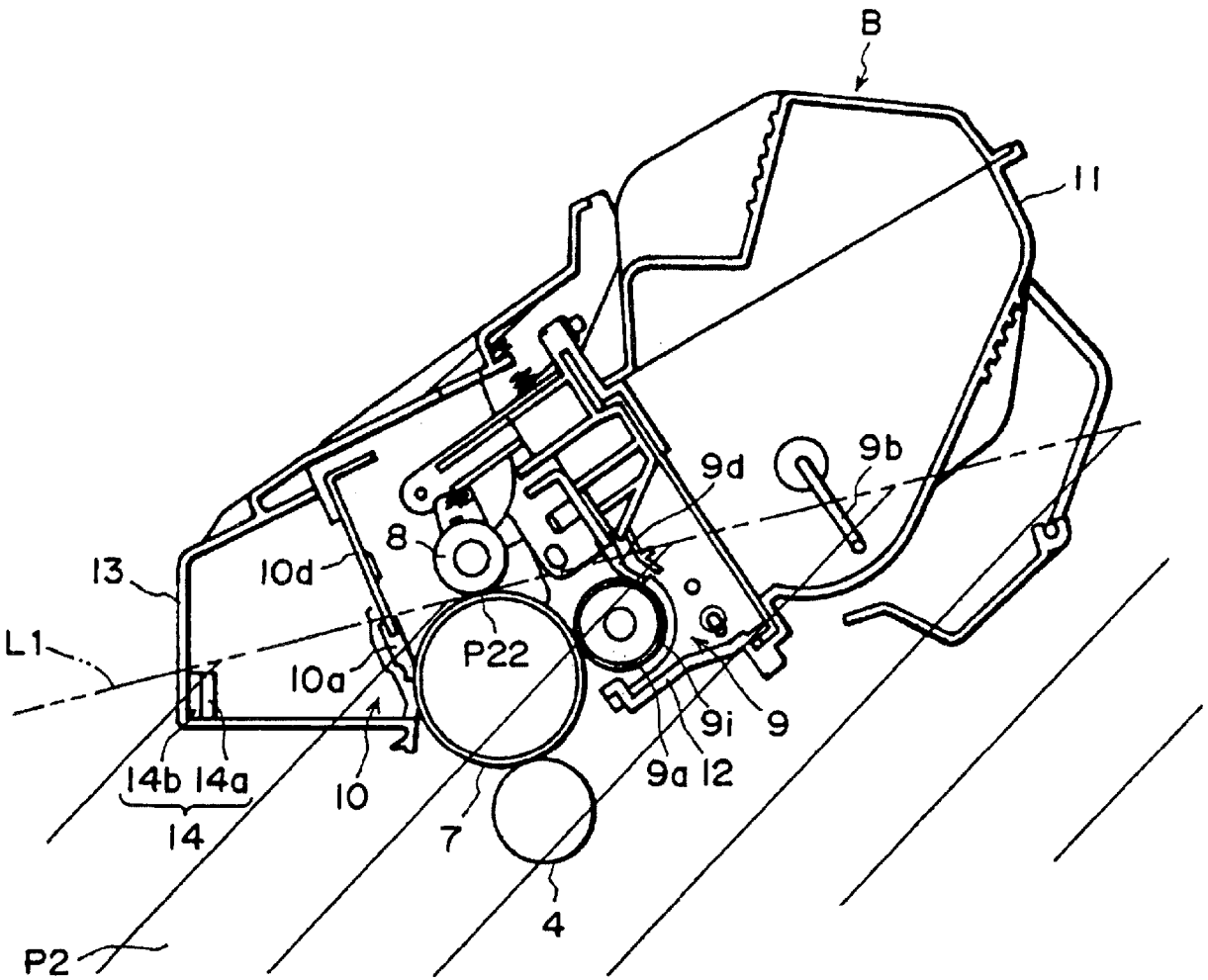
FIG. 3 is a sectional view of the process cartridge in the second embodiment of the present invention.

FIG. 3 is a sectional view of the process cartridge in this embodiment. In this embodiment, the information storing means 14 is placed in a region P2 (hatched region), which is on the photosensitive drum 7 side with respect to a plane L1, which is tangent to peripheral surface of the photosensitive drum 7 at the linear interface P22 between the charge roller 8 and photosensitive drum 7, and intersects (approximately perpendicular) the longitudinal direction of the photosensitive drum 7, as shown in FIG. 3. Since the information storing means 14 is placed in the region P2 (hatched region), which is on the photosensitive drum 7 side with respect to a plane L1, which is tangent to peripheral surface of the photosensitive drum 7 at the linear interface P22 between the charge roller 8 and photosensitive drum 7, and intersects (approximately perpendicular) the longitudinal direction of the photosensitive drum 7, the information storing means 14 is shielded by the photosensitive drum 7 from the noises generated by the charge bias applied to the charge roller 8. More specifically, the photosensitive drum 7 is electrically connected to the ground contact point member of the image forming apparatus main assembly A1 through the ground contact point, and therefore, the noises from the charge bias are led to the ground contact point member of the image forming apparatus main assembly A1 through the ground contact point. of the photosensitive drum 7. In other words, the noises which dissipate from the linear interface P22 are blocked by the portion of the peripheral surface of photosensitive drum 7 in the region P2 on the photosensitive drum 7 side with respect to the aforementioned plane L1 tangent to the peripheral surface of the photosensitive drum 7 at the linear interface P22. With this arrangement, it is possible to prevent the problem that the predetermined information stored in the information storing portion 14*a* of the information storing means 14 is destroyed, or written over with erroneous information, by the effects of the noises from the charge bias applied to the charge roller 8. Thus, it is possible to prevent the problem that the information storing means 14 is caused to destroy the information stored therein, or to erroneously operate, by the noises from the charge bias applied to the charge roller 8.

Embodiment 3

In this embodiment, another example of a process cartridge in accordance with the present invention will be described. In this cartridge, in order to prevent the information storing means 14 from being affected by the noises caused by the transfer bias applied to the transfer roller 4 of the process cartridge B, the information storing means 14 is placed within the cleaning means frame 13. The components in this cartridge similar to those in the process cartridge B in the first embodiment are given the same reference codes as those in the first embodiment.

Figure 4:
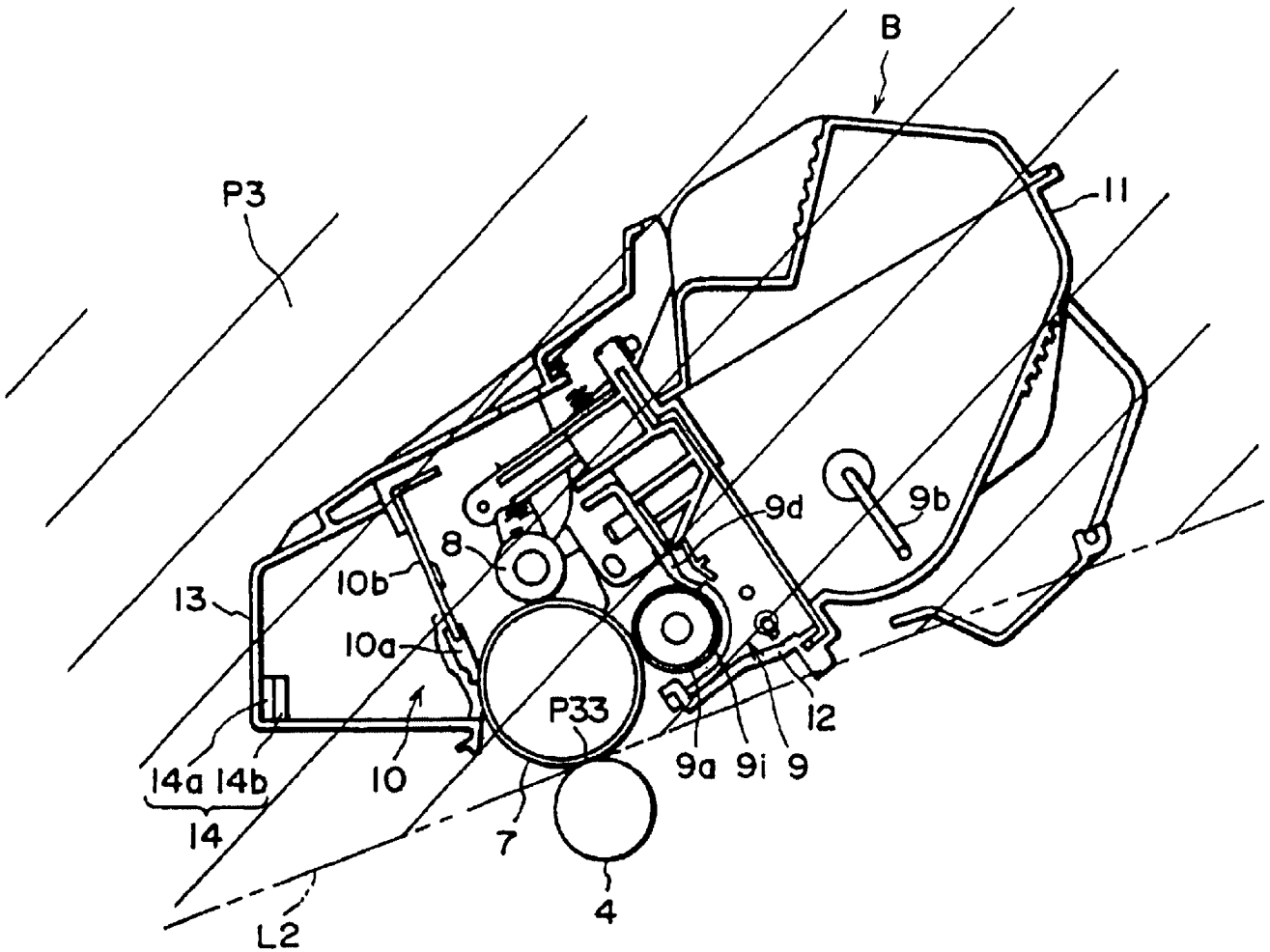
FIG. 4 is a sectional view of the process cartridge in the third embodiment of the present invention.

FIG. 4 is a sectional view of the process cartridge in this embodiment. In this embodiment, the information storing means 14 is placed in a region P3 (hatched region), which is on the photosensitive drum 7 side with respect to a plane L2, which is tangent to peripheral surface of the photosensitive drum 7 at the linear interface P33 between the transfer roller 4 and photosensitive drum 7, and intersects (approximately perpendicular) the longitudinal direction of the photosensitive drum 7, as shown in FIG. 4. Since the information storing means 14 is placed in the region P3 (hatched region), which is on the photosensitive drum 7 side with respect to a plane L2, which is tangent to peripheral surface of the photosensitive drum 7 at the linear interface P33 between the transfer roller 4 and photosensitive drum 7, and intersects (approximately perpendicular) the longitudinal direction of the photosensitive drum 7, the noises caused by the transfer bias applied to the transfer roller 4 are blocked by the photosensitive drum 7. More specifically, the photosensitive drum 7 is electrically connected to the ground contact point member of the image forming apparatus main assembly A1 through the ground contact point, and therefore, the noises from the transfer bias are led to the ground contact point member of the image forming apparatus main assembly A1 through the ground contact point of the photosensitive drum 7. In other words, the noises which dissipate from the linear interface P33 are blocked by the portion of the peripheral surface of photosensitive drum 7 in the region P3 on the photosensitive drum 7 side with respect to the aforementioned plane L2 tangent to the peripheral surface of the photosensitive drum 7 at the linear interface P33. With this arrangement, it is possible to prevent the problem that the predetermined information stored in the information storing portion 14*a* of the information storing means 14 is destroyed, or written over with erroneous information, by the effects of the noises from the transfer bias applied to the transfer roller 4. Thus, it is possible to prevent the problem that the information storing means 14 is caused to destroy the information stored therein, or to erroneously operate, by the noises from the transfer bias applied to the transfer roller 4.

Embodiment 4

In this embodiment, another example of a process cartridge in accordance with the present invention will be described. In this cartridge, in order to prevent the information storing means 14 from being affected by the noises caused by the development bias applied to the charge roller 8 of the process cartridge B, the information storing means 14 is placed within the cleaning means frame 13. The components in this embodiment similar to those the first embodiment are given the same reference codes as those in the first embodiment.

Figure 5:
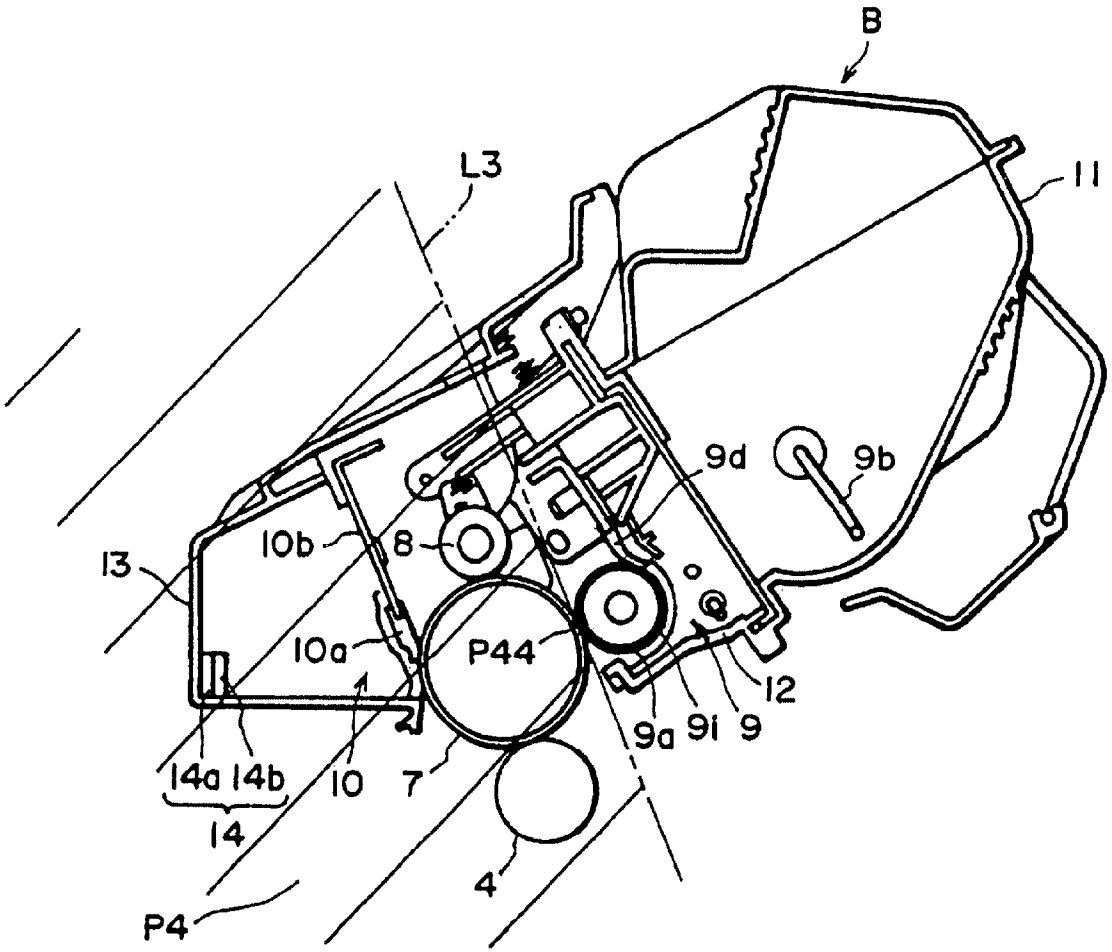
FIG. 5 is a sectional view of the process cartridge in the fourth embodiment of the present invention.

FIG. 5 is a sectional view of the process cartridge in this embodiment. In this embodiment, the information storing means 14 is placed in a region P4 (hatched region), which is on the photosensitive drum 7 side with respect to a plane L3, which is tangent to peripheral surface of the photosensitive drum 7 at the linear interface P44 between the spacer ring 9*i* of the development sleeve 9*a* and the photosensitive drum 7, and intersects (approximately perpendicular) the longitudinal direction of the photosensitive drum 7, as shown in FIG. 5. Since the information storing means 14 is placed in the region P4 (hatched region), which is on the photosensitive drum 7 side with respect to the plane L3, which is tangent to peripheral surface of the photosensitive drum 7 at the linear interface P44 between the spacer ring 9*i* of the development sleeve 9*a* and the photosensitive drum 7, and intersects (approximately perpendicular) the longitudinal direction of the photosensitive drum 7, the noises caused by the development bias applied to the development sleeve 9*a* are blocked by the photosensitive drum 7. More specifically, the photosensitive drum 7 is electrically connected to the ground contact point member of the image forming apparatus main assembly A1 through the ground contact point, and therefore, the noises from the development bias are led to the ground contact point member of the image forming apparatus main assembly A1 through the ground contact point of the photosensitive drum 7. In other words, the noises which dissipate from the linear interface P44 are blocked by the portion of the peripheral surface of photosensitive drum 7 in the region P4 on the photosensitive drum 7 side with respect to the aforementioned plane L3 tangent to the peripheral surface of the photosensitive drum 7 at the linear interface P44. Therefore, it is possible to prevent the problem that the predetermined information stored in the information storing portion 14*a* of the information storing means 14 is destroyed or written over with erroneous information, by the effects of the noises from the development bias applied to the development sleeve 9*a*. Thus, it is possible to prevent the problem that the information storing means 14 is caused to destroy the information stored therein, or to erroneously operate, by the noises from the development bias applied to the development sleeve 9*a*.

Embodiment 5

This embodiment, which will be described next, is a case in which the information storing means 14 is placed within the cleaning means frame 13 to prevent the information storing means 14 from being subjected to the effects of the noises generated by the charge bias applied to the charge roller 8 of the process cartridge B, the noises generated by the development bias applied to the development sleeve 9*a* of the process cartridge B, and the noises generated by the transfer bias applied to the transfer roller 4 of the image forming apparatus main assembly A1. The components in this embodiment similar to those in the first embodiment are given the same reference codes as those in the first embodiment.

Figure 6:
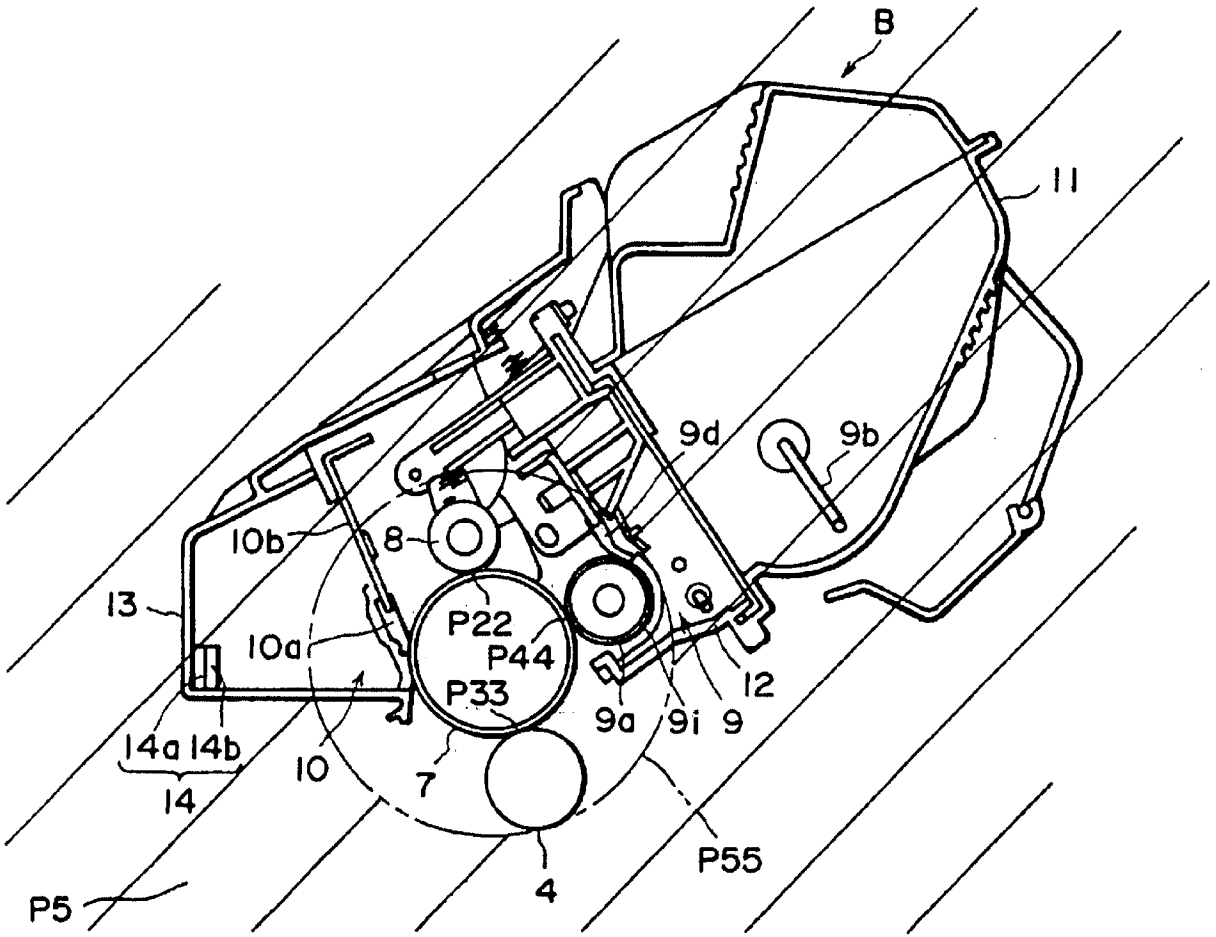
FIG. 6 is a sectional view of the process cartridge in the fifth embodiment of the present invention.

FIG. 6 is a sectional view of the process cartridge in this embodiment. In this embodiment, the information storing means 14 is in a region P5 (hatched region), that is, the region outside a theoretical cylinder P55, the axial line of which coincides with the rotational center (axial line) of the photosensitive drum 7, and which is in contact with the peripheral surface of the photosensitive drum 7 and envelops all the processing members, that is, the transfer roller 4, charge roller 8, and development sleeve 9*a*, to which bias is applied from the image forming apparatus main assembly A1. Since the information storing means 14 is placed outside the theoretical cylinder P55, the axial line of which coincides with the rotational center (axial line) of the photosensitive drum 7, and which is in contact with the peripheral surface of the photosensitive drum 7 and envelops all the processing members to which bias is applied from the image forming apparatus main assembly A1, the noises generated by the transfer bias applied to the transfer roller 4, the noises generated by the charge bias applied to the charge roller 8, and the noises generated by the development bias applied to the development sleeve 9*a*, are all blocked by the photosensitive drum 7. More specifically, the photosensitive drum 7 is electrically connected to the ground contact point member of the image forming apparatus main assembly A1 through the ground contact point, and therefore, the noises generated by the transfer bias, charge bias, and development bias, at the-linear interface P22 between the photosensitive drum 7 and transfer roller 4, the linear interface P33 between the photosensitive drum 7 and charge roller 8, and the linear interface P44 between the photosensitive drum 7 and development roller 9*a*, correspondingly, are led to the ground contact point member of the image forming apparatus main assembly A1 through the ground contact point of the photosensitive drum 7. In other words, the noises which dissipate from the linear interface P22 between the photosensitive drum 7 and transfer roller 4, the linear interface P33 between the photosensitive drum 7 and charge roller 8, and the linear interface P44 between the photosensitive drum 7 and development roller 9*a*, correspondingly, are blocked by the portion of the peripheral surface of the photosensitive drum 7 at and in the adjacencies of the linear interfaces P22, P33, and P44, within the theoretical cylinder P55. Therefore, it is possible to prevent the problem that the predetermined information which the information storing portion 14*a* of the information storing means 14 stores is destroyed or written over with erroneous information by the effects of the noises generated by the biases applied to the aforementioned processing members. Thus, it is possible to prevent the problem that the information storing means 14 is caused by the effects of the noises generated by the biases applied to the processing members, to destroy the contents of the information storing portion 14*a*, or to erroneously operate.

Miscellaneous Embodiments

The process cartridges in the preceding embodiments were for forming a monochromatic image. However, the present invention is also applicable, with excellent results, to a process cartridge which is enabled to form a multicolor image (for example, two tone image, three tone image, or full-color image) with the provision of a plurality of developing means.

The selection of the electrophotographic photosensitive member does not need to be limited to the aforementioned photosensitive drum. For example, it may include the following. As for the photosensitive material, various photoconductors, for example, amorphous silicon, amorphous selenium, zinc oxide, titanium oxide, as well as organic photoconductors, may be employed. As for the shape of the base member on which the photosensitive material is borne, it may be in the form of a drum or a belt, for example. In the case of a drum type photosensitive member, it is produced by depositing or painting photoconductor on the peripheral surface of a cylindrical base member formed of aluminum alloy or the like.

The definition of the aforementioned process cartridge, in other words, a cartridge to which the present invention is applicable, is such a cartridge that comprises, for example, an electrophotographic photosensitive member, and at least one processing means. In other words, in addition to the process cartridge referred to in the descriptions of the preceding embodiments, there are many process cartridges of various forms, to which the present invention is applicable; for example, a cartridge in which an electrophotographic photosensitive member and a charging member are integrally placed so that they can be removably installed in the apparatus main assembly, a cartridge in which an electrophotographic photosensitive member and a developing means are integrally placed so that they can be removably installed in the apparatus main assembly, a cartridge in which an electrophotographic photosensitive member and a cleaning means are integrally placed so that they can be removably installed in the apparatus main assembly, a process cartridge in which an electrophotographic photosensitive member and a combination of two or more among the aforementioned processing means are integrally placed so that they can be removably installed in the apparatus main assembly, and the like cartridges.

In other words, the definition of the aforementioned process cartridge is a cartridge which is removably installable in the image forming apparatus main assembly, and in which a charging means, a developing means or a cleaning means, and an electrophotographic photosensitive member, are integrally placed, a cartridge which is removably installable in the image forming apparatus main assembly, and in which at least one among a charging means, a developing means and a cleaning means, and an electrophotographic photosensitive member, are integrally placed, or a cartridge which is removably installable in the image forming apparatus main assembly, and in which at least a developing means and an electrophotographic photosensitive member are integrally placed. Thus, the apparatus main assembly can be maintained by a user himself or herself.

Further, in the preceding embodiments, a laser beam printer was referred to as an electrophotographic image forming apparatus. However, the application of the present invention does not need to be limited to a laser beam printer. Obviously, the present invention is also applicable to electrophotographic image forming apparatus of other forms, for example, electrophotographic copying machines, facsimile apparatuses, and word processors.

As described above, a process cartridge in accordance with the present invention can prevent the problem that the contents of the information storing means which wirelessly communicates with the electrophotographic image forming apparatus main assembly are destroyed or written over with erroneous information by the effects of the electrical noises generated by bias application.

An electrophotographic image forming apparatus in accordance with the present invention can removably accommodate a process cartridge in accordance with the present invention which can prevent the problem that the contents of the information storing means which wirelessly communicates with the electrophotographic image forming apparatus main assembly are destroyed or written over with erroneous information by the effects of the electrical noises generated by bias application.

While the invention has been described with reference to the structured disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus having a transferring roller and main assembly communication means, said process cartridge comprising:

an electrophotographic photosensitive drum;

cleaning means, contacting said electrophotographic photosensitive drum, for removing developer remaining on said electrophotographic photosensitive drum;

a developer accommodating portion configured to accommodate the developer removed from said electrophotographic photosensitive drum by said cleaning means;

a developing roller configured and positioned to develop an electrostatic latent image formed on said electrophotographic photosensitive drum with the developer; and storing means, including an information storing portion configured to store predetermined information and cartridge communicating means for effecting wireless communication of the predetermined information stored in said information storing portion with the main assembly communication means, wherein said storing means is disposed inside said developer accommodating portion, and said storing means is disposed at a leading side with respect to a direction in which in said process cartridge is mounted to the main assembly of the apparatus;

wherein said electrophotographic photosensitive drum contacts along the length thereof the transferring roller for receiving a bias voltage to transfer a developed image provided by said developing roller onto a recording material; and wherein said storing means is disposed at the same side of said process cartridge as said electrophotographic photosensitive drum with respect to a tangent line passing through a contact point between said electrophotographic photosensitive drum and the transferring roller extending in a direction crossing the longitudinal direction of said electrophotographic photosensitive drum.

2. A process cartridge detachably mountable to a main assembly of an electrophotographic image forming apparatus having main assembly communication means, comprising:

an electrophotographic photosensitive drum;

cleaning means, contacting said electrophotographic photosensitive drum, for removing developer remaining on said electrophotographic photosensitive drum;

a developer accommodating portion configured to accommodate the developer removed from said electrophotographic photosensitive drum by said cleaning means;

a developing roller configured and positioned to receive a bias voltage and to contact said electrophotographic photosensitive drum along the length of said electrophotographic photosensitive drum to develop an electrostatic latent image formed on said electrophotographic photosensitive drum with the developer; and storing means including an information storing portion configured to store predetermined information and cartridge communicating means for effecting wireless communication of the predetermined information stored in said information storing portion with the main assembly communication means, wherein said storing means is disposed inside said developer accommodating portion, and said storing means is disposed at a leading side with respect to a direction in which in said process cartridge is mounted to the main assembly of the apparatus;

wherein said storing means is disposed at the same side of said process cartridge as said electrophotographic photosensitive drum with respect to a tangent line passing through a contact point between said electrophotographic photosensitive drum and said developing roller and extending in a direction crossing the longitudinal direction of said electrophotographic photosensitive drum.

3. An electrophotographic image forming apparatus for forming an image on a recording material, to which a process cartridge is detachably mountable, said apparatus comprising:

(a) a transferring roller configured and positioned to cause the transfer of a developed image from an electrophotographic photosensitive drum of the process cartridge to the recording material;

(b) main assembly side communicating means provided in a main assembly of said image forming apparatus for wirelessly communicating with cartridge communicating means of the process cartridge;

(c) mounting means for detachably mounting the process cartridge, the process cartridge including:

the electrophotographic photosensitive drum;

cleaning means, contacting the electrophotographic photosensitive drum, for removing developer remaining on the electrophotographic photosensitive drum;

a developer accommodating portion configured to accommodate the developer removed from the electrophotographic photosensitive drum by the cleaning means;

a developing roller configured and positioned to develop an electrostatic latent image formed on the electrophotographic photosensitive drum with the developer; and storing means including an information storing portion configured to store predetermined information and the cartridge communicating means for wireless communication of the predetermined information stored in the information storing portion with said main assembly side communicating means;

wherein the storing means is disposed inside the developer accommodating portion, and the storing means is disposed at a leading side with respect to a direction in which in the process cartridge is mounted to the main assembly of said image forming apparatus;

wherein the electrophotographic photosensitive drum contacts along the length thereof said transferring roller for receiving a bias voltage to transfer the developed image provided by the developing roller onto the recording material; and wherein the storing means is disposed at the same side of the process cartridge as the electrophotographic photosensitive drum with respect to a tangent line passing through a contact point between the electrophotographic photosensitive drum and said transferring roller and extending in a direction crossing the longitudinal direction of the electrophotographic photosensitive drum; and (d) feeding means for feeding the recording material.

4. An electrophotographic image forming apparatus for forming an image on a recording material, to which a process cartridge is detachably mountable, said apparatus comprising:

(a) main assembly communicating means provided in a main assembly of said image forming apparatus for wirelessly communicating with cartridge communicating means of the process cartridge;

(b) mounting means for detachably mounting the process cartridge, the process cartridge including:

an electrophotographic photosensitive drum;

cleaning means, contacting the electrophotographic photosensitive drum, for removing developer remaining on the electrophotographic photosensitive drum;

a developer accommodating portion configured to accommodate the developer removed from the electrophotographic photosensitive drum by the cleaning means;

a developing roller configured and positioned to receive a bias voltage and contacting the electrophotographic photosensitive drum along the length of the electrophotographic photosensitive drum to develop an electrostatic latent image formed on the electrophotographic photosensitive drum with the developer; and storing means including an information storing portion configured to store predetermined information and the cartridge communicating means for wireless communication of the predetermined information stored in the information storing portion with said main assembly communicating means, wherein the storing means is disposed inside the developer accommodating portion, and the storing means is disposed at a leading side with respect to a direction in which in the process cartridge is mounted to the main assembly of said image forming apparatus; and wherein said storing means is disposed at the same side of the process cartridge as the electrophotographic photosensitive drum with respect to a tangent line passing through a contact point between the electrophotographic photosensitive drum and the developing roller and extending in a direction crossing the longitudinal direction of the electrophotographic photosensitive drum; and (c) feeding means for feeding the recording material.

* * * * *

UNITED STATES PATENT AND TRADEMARK OFFICE

CERTIFICATE OF CORRECTION

PATENT NO. : 6,859,626 B2
DATED : February 22, 2005
INVENTOR(S) : Kimizuka et al.

It is certified that error appears in the above-identified patent and that said Letters Patent is hereby corrected as shown below:

Column 2,
Line 8, “above described” should read -- above-described --.

Column 3,
Line 60, “(hereinafter” should read -- (hereinafter referred to as --.

Column 4,
Lines 12 and 52, “(hereinafter” should read -- (hereinafter referred to as --.

Column 7,
Line 28, “above described” should read -- above-described --.
Lines 60 and 67, “perpendicular)” should read -- perpendicularly) --.

Column 8,
Line 10, “point.” should read -- point --.
Line 51, “perpendicular)” should read -- perpendicularly) --.

Column 9,
Lines 28 and 36, “perpendicular)” should read -- perpendicularly) --.

Column 12,
Line 41, “apparatus;” should read -- apparatus, --.
Line 46, “material;” should read -- material, --.

Column 13,
Line 15, “apparatus;” should read -- apparatus, and --.
Line 55, “means;” should read -- means, --.
Line 60, “apparatus;” should read -- apparatus, --.

UNITED STATES PATENT AND TRADEMARK OFFICE

CERTIFICATE OF CORRECTION

PATENT NO. : 6,859,626 B2
DATED : February 22, 2005
INVENTOR(S) : Kimizuka et al.

It is certified that error appears in the above-identified patent and that said Letters Patent is hereby corrected as shown below:

Column 14,
Line 5, “material;” should read -- material, --.
Line 49, “apparatus;” should read -- apparatus, --.

Signed and Sealed this

Thirtieth Day of August, 2005

JON W. DUDAS
*Director of the United States Patent and Trademark Office*